US010161082B1

(12) United States Patent
Chapman

(10) Patent No.: US 10,161,082 B1
(45) Date of Patent: Dec. 25, 2018

(54) CONTACT SURFACE HAVING A COMPOSITE RELEASE LAYER AND METHOD OF MAKING

(71) Applicant: Fluoron Inc., Elkton, MD (US)

(72) Inventor: Randall F. Chapman, Elkton, MD (US)

(73) Assignee: Fluoron Inc., Elkton, MD (US)

( * ) Notice: Subject to any disclaimer, the term of this patent is extended or adjusted under 35 U.S.C. 154(b) by 0 days.

(21) Appl. No.: 15/201,492

(22) Filed: Jul. 3, 2016

Related U.S. Application Data

(60) Provisional application No. 62/188,593, filed on Jul. 3, 2015.

(51) Int. Cl.
*D21F 5/02* (2006.01)
*B65H 27/00* (2006.01)

(52) U.S. Cl.
CPC ..... *D21F 5/021* (2013.01); *B65H 27/00* (2013.01); *B65H 2404/18* (2013.01)

(58) Field of Classification Search
CPC ... D21F 5/02; D21F 5/021; D21F 3/08; D21F 3/10; D21G 1/02; D21G 1/0246; B65H 2404/10; B65H 2404/11; B65H 2404/122; B65H 2404/18; B65H 2404/181; B65H 2404/182; B65H 2404/186; B65H 2404/187; B65H 27/00
USPC ..... 162/272, 372–374; 492/20, 53, 54, 56, 492/58, 59
See application file for complete search history.

(56) References Cited

U.S. PATENT DOCUMENTS 5,257,966 A * 11/1993 Watanabe ..... F16C 13/00 100/155 R
6,623,601 B2 * 9/2003 Graf ..... B29C 70/84 162/272
2014/0127526 A1 * 5/2014 Etschmaier ..... D21F 1/40 428/551

* cited by examiner

*Primary Examiner* — Eric Hug
(74) *Attorney, Agent, or Firm* — Invention To Patent Services; Alex Hobson

(57) ABSTRACT

A processing roll has a release layer that includes a porous rigid layer and polymer composite. The porous rigid layer may be a thermally sprayed metal that has discrete metal portions or a network of contiguous metal portions. Discrete metal from a flame sprayer may attached to each other on a contact surface to form the rigid layer. The polymer composite at least partially fills the spaces between the metal portions. The polymer composite may comprise a particulate filler, such as silica or glass beads. The release layer has good durability as the exposed surface contains both a portion that is the rigid material and a portion that is the polymer composite. This configuration enables very high release and long term durability even as the release layer wears.

7 Claims, 7 Drawing Sheets

CONTACT SURFACE HAVING A COMPOSITE RELEASE LAYER AND METHOD OF MAKING

CROSS REFERENCE TO RELATED APPLICATIONS

This application claims the benefit of U.S. provisional patent application No. 62/188,593, filed on Jul. 3, 2015, and entitled Contact Surface Having a Composite Release Layer and Method of Making; the entirety of which is hereby incorporated by reference herein.

BACKGROUND OF THE INVENTION

Field of the Invention

This invention relates to a composite release layer that is attached to a contact surface, such as the outer portion of processing rolls, having a composite structure comprising a porous rigid layer and a polymer composite configured within the spaces of the porous rigid layer.

Background

Paper processing is operated at high line speeds and any breaks in the paper during the process leads to downtime and possible machine damage. In cases where the process, or paper product comprises adhesives, waxes or other tacky materials, the processing rolls may need to have sufficient release to reduce line breaks. For example, paper produced from recycled materials typically contain stickies, or tacky substances such as adhesives, waxes and hot melts, within the paper pulp and/or process water. These stickies have a tendency to collect or deposit on the processing equipment and particular the processing rolls and/or doctor blades used to peel the paper product from the roll. Drying rolls are particular susceptible to deposition of stickies on the rolls which can lead to breaks in the paper product being processed as it sticks to the roll and subsequently rips.

There exits coating for reducing the sticking of the paper to the processing rolls, however, the durability of these coatings is too low as the coating wears off leading to paper breaks. Changing out of processing rolls is a very time consuming process which costs the manufactures down time. In addition, each time a release layer is applied to a roll, there are additional costs. Many coatings applied directly to the processing rolls are susceptible to wear and peeling from the doctor blade or blades. In addition, the initial release properties of conventional coatings are often not sufficient to adequately prevent the paper from sticking.

There exists a long felt need for processing rolls and contact surfaces that can sufficient prevent paper products having stickies from sticking to the rolls and is durable to ensure a long life of the coating.

SUMMARY OF THE INVENTION

The invention is directed to a contact surface having a composite release layer as described herein. In an exemplary embodiment, the contact surface is the outer cylindrical portion of processing rolls. In an exemplary embodiment, the processing rolls of the present invention are utilized in paper manufacturing or in any other processing where an adhesive or hot melt may collect or deposit on the rolls. For example, when paper is produced from recycled materials there are tacky substances, stickies, such as adhesives, waxes and hot melts within the paper pulp and/or process water. These stickies collect or deposit on the processing equipment and particular the processing rolls and/or doctor blades used to peel the paper product from the roll. Drying rolls are particular susceptible to deposition of stickies on the rolls which can lead to breaks in the paper product being processed as it sticks to the roll and subsequently rips. It is to be understood that the rolls and/or coating on the rolls described herein may be utilized in any suitable process and particularly processes where an adhesive may contact the rolls.

In an exemplary embodiment, a processing roll comprises a composite release layer, as described herein, on an outside contact surface of the processing roll. A processing roll may be any suitable size and have a length and diameter suitable for the processing conditions. Typical dryer rolls in the paper industry are 48 in in diameter by 10 ft long, 60 in in diameter by 20 ft to 30 ft long, and 72 in in diameter by 30 to 40 ft long. Relatively small dryer rolls in the paper industry may be 42 in in diameter by 8 ft long or 23 in in diameter by 72 in in length. Most paper dryer processing rolls are rather large in diameter, such as more than about 1 meter in diameter or larger, to provide adequate contact for drying the paper product. This longer period of contact can increase the likelihood of the paper product sticking to the rolls. A roll may be one meter or longer, three meters or longer, five meters or longer, ten meters or longer and any range between and including the lengths provided. Most processing rolls are typically metal, such as steel or cast iron which does not have adequate release properties for processing material with stickies.

An exemplary composite release layer of the present invention comprises a porous rigid layer and a polymer composite. An exemplary rigid layer is a porous metal layer comprising a plurality of metal portions. The polymer composite is configured in the spaces of the porous rigid layer and, in an exemplary embodiment, substantially fills the spaces between the plurality of rigid portions or metal portions. The release layer may have any suitable thickness such as no more than about 5 mm, no more than about 2 mm, no more than about 1 mm, no more than about 100 μm, no more than about 50 μm and any range between and including the thickness values provided.

An exemplary porous rigid layer, such as a layer comprising metal or ceramic, is configured on the outside of the processing roll and over the contact surface, or area where the processing material such as paper will contact the roll. The porous metal layer comprises a plurality of metal portions dispersed over the surface of the roll. The plurality of metal portions may extend up from the roll and may be discrete, wherein they do not contact each other. In another embodiment, the plurality of metal portions are coupled together into a substantially contiguous network of connected metal portions having spaces therebetween the network. The size of the rigid, and/or metal portions, and/or the space between the plurality of metal portions may be any suitable size including but not limited to no more than about 200 μm, no more than about 100 μm, no more than about 50 μm, no more than about 25 μm, no more than about 10 μm, no more than about 5 μm, and any range between and including the space sizes provided. The porous metal layer may comprise any suitable type of metal, but is preferably a hard metal to ensure suitable durability, such as tungsten carbide, nickel, chromium and composites thereof. The porous metal layer may be deposited or otherwise configured on the roll by any suitable means. A preferred means is thermal spraying of a material, such as a metal, wherein the metal is melted and sprayed onto a surface. Particles of metal are deposited onto the surface and the thickness and size can be controlled through the thermal spraying processing parameter including temperature, and gas flow through the nozzle. A thermal spray coating is available through PraxAir Inc., Danbury Conn., such as SermeTel CF Coatings, Sermaloy J CF Coating and the like. In one embodiment, a thermal spraying process heats a feedstock through an electrical arc, plasma or chemical means. Other techniques that may be used to create a porous rigid layer include plasma spraying, detonation spraying, wire arc spraying, flame spraying, high velocity oxy-fuel coating spraying and the like. Other materials that may be thermally sprayed, or otherwise deposited to form a porous rigid layer include alloys, ceramics, plastics, and composites.

A porous rigid layer may comprise juts, or rigid portions that extend out from the contact surface more than the average coating thickness. These juts may be removed before or after application of the polymer composite by any suitable means including scrapping, sanding, polishing, particle blasting and the like. In an exemplary embodiment, a processing roll coated with the porous rigid layer may be rotated with a scraping implement pressed against the outer surface to remove the juts.

An exemplary polymer composite comprises a polymer and a particulate filler. In a preferred embodiment, the polymer comprises silicone and a particulate filler comprises glass microspheres or beads. An exemplary polymer is Dow Corning 1890 Protective Coating. The particulate filler may reinforce the polymer and make it more durable. The particulate filler may also ensure that the polymer wears in a progressive and uniform way, wherein large portions of the polymer are not pulled off, rather, the polymer is slowly abraded away as the particulate filler creates separation locations for wear. Any other type of filler may be used including silica, silica gel, silica or glass powder and the like. A particulate filler may be added to the polymer composite in any suitable weight percent of the polymer composite including, but not limited to, about 0.25% or more, about 0.5% or more, about 1% or more, about 2% or more, about 5% or more, and any range between and including the weight percentages provided. Too much particulate filler may weaken the polymer and reduce durability. A particulate filler may have any suitable mean particle size such as about 50 μm or less, about 30 μm or less, about 20 μm or less about 10 μm or less.

The polymer composite may comprise or consist essentially of silicone, urethanes, fluoro-elastomers, viton, fluorosilicones and the like. Silicone is a preferred polymer not only because of the release properties but also because it can be applied in a fluid state and worked into the spaces within the porous rigid layer before it cures. Acetic silicone releases acetic acid as they cure. Neutral silicone releases alcohol as they cure and have no smell but generally take longer, about three times longer to cure than acetic silicone. An acetic silicone may be referred to as an RTV silicone. This moisture or room temperature curing is preferred as it requires no additional processing equipment to cure the polymer.

The polymer composite may be applied or deposited onto the porous metal layer through any means including spraying, brushing, doctor blade, transfer rolls and the like. In an exemplary embodiment, the polymer composite is sprayed onto the contact surface of the processing roll. The processing roll may be rotated at any suitable speed and the polymer composite may be sprayed onto the outer surface of the processing roll. The speed of revolution of the processing roll during application or deposition of the polymer composite may be 25 revolutions per minute (rpm), 50 rpm or more, 100 rpm or more, or 150 rpm or more. The surface speed of the roller will depend on the diameter and the revolutions per minute and may be 50 feet per minute (fpm) or more, about 75 fpm or more, about 100 fpm or more, about 150 fpm or more and any range between and including the rates provided. A thinning agent or material may be added to better enable spraying of the polymer composite and to help the polymer composite to fill the spaces within the porous rigid layer. A thinning agent, such as a hydrocarbon or naptha, for example, may be used to reduce the viscosity of the polymer composite. A thinning agent may be added to the polymer composite in any suitable weight percentage, such as about 10% or less, about 20% or less, about 25% or less, about 35% or less. Too much thinning agent may compromise the curing and strength of the polymer composite. The polymer composite may be forced or pressed into the processing roll or other contact surface by the use of a doctor blade or other implement that moves across the contact surface and presses the polymer composite into the voids or spaces of the porous rigid layer. During or after the polymer composite is applied to the porous metal layer, the surface may be scraped to remove any excess polymer composite material from the surface. A doctor blade may be pressed against the surface of the processing roll and the roll may be rotated to scrape away excess polymer coating from the surface and to reduce any high points from the porous metal layer. In addition, the doctor blade may help to force the polymer composite into the porous rigid or metal layer.

An exemplary release layer has an outside surface, or surface that is exposed to processing material that has exposed porous rigid layer material and polymer composite. The ratio of the exposed surfaces, porous rigid layer material to polymer composite, may be any suitable ratio, such as about 1:1, about 0.5:1, about 0.25:1, about 0.10:1 and any range between and including the ratios provided.

A process for making a roll having a release layer, as described herein is provided. The process comprises the steps of depositing a porous rigid layer onto the contact surface The porous rigid layer may be a porous metal, ceramic or metal alloy layer that is deposited through flame or thermal spraying. Any juts may be removed prior to the application of the polymer composite as described herein to provide a substantially uniform thickness of the porous rigid layer. A polymer composite, as described herein is then applied to the porous rigid layer and a doctor blade or other scraping implement may be used to remove any excess polymer composite from the surface and/or press the polymer composite into the asperities of the porous metal layer. For example, a processing roll may be rotated in a first direction with a doctor blade in contact with the outside surface to press the polymer composite into the spaces between the rigid portions, and then run in the opposing rotation direction to remove any excess polymer composite from the surface and to remove any juts, or rigid portions that extend up past the outside surface. In an exemplary process, the processing roll is rotated while the polymer composite is sprayed and a doctor blade presses the polymer composite into the porous rigid layer. The polymer composite may be silicone that cures overtime with moisture, such as an RTV silicone. The processing roll may be rotated and scraped until the polymer composite is cured. In another embodiment, a polymer composite, such as a thermoplastic is deposited onto the porous rigid layer in a fluid state, or melted. The thermoplastic polymer may be melted and the processing roll may be heated to further enable the thermoplastic to flow into the spaces within the porous rigid layer.

In an alternative embodiment, a primer polymer or material is coated onto the processing roll and/or the porous rigid layer prior to the polymer composite being applied. An exemplary primer material is Dow Corning 1200 RTV prime coat. This primer may be diluted and coated onto the processing roll and cured prior to applying the polymer composite. A primer layer may provide a very thin layer, such as about no more than about 20 μm, no more than about 10 μm, no more than about 5 μm, no more than about 2 μm and any range between and including the thickness values provided. A primer may ensure good bond of the polymer to the contact surface of the roll and/or to the porous rigid layer.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
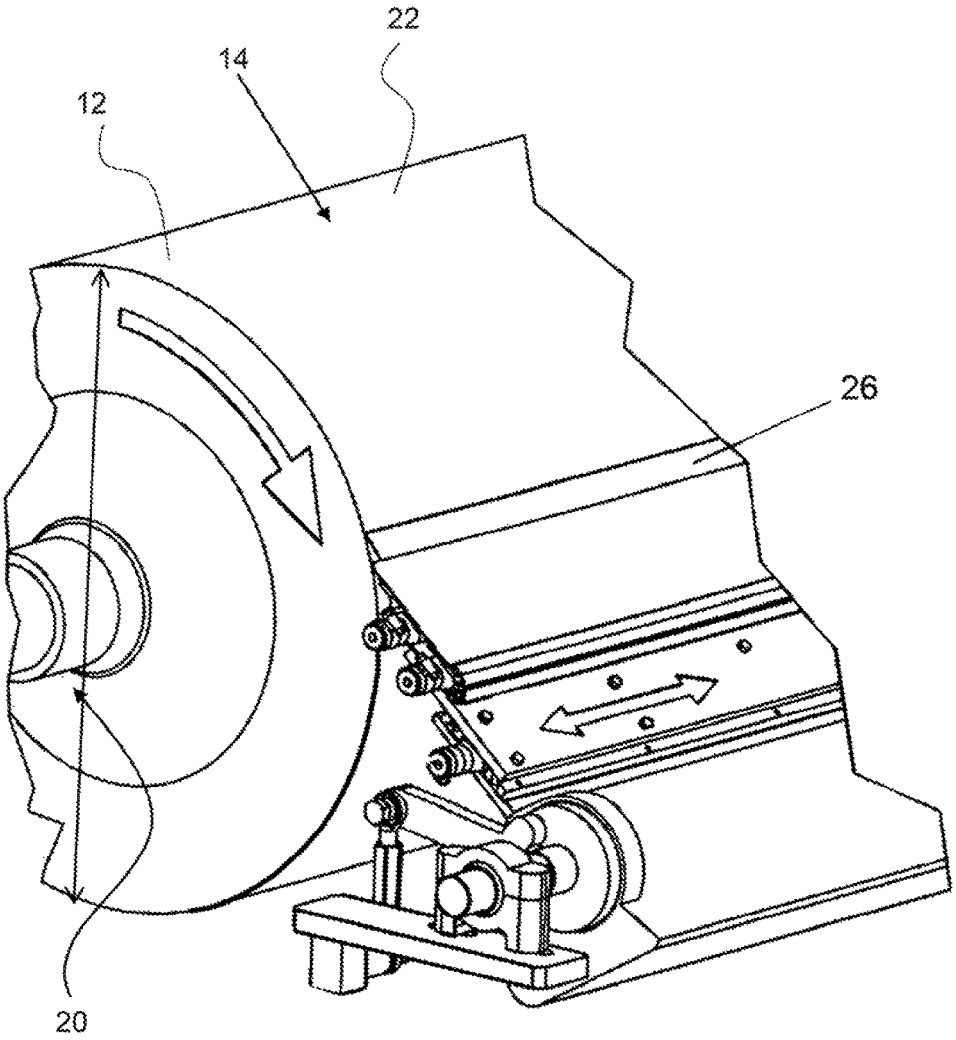
FIG. 1 shows an exemplary processing roll having a doctor blade contacting the contact surface.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises." "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary processing roll 12 has an exemplary composite release layer 14 on the contact surface 22 and a doctor blade 26. The diameter 20 of the processing roll is shown. As described herein, a doctor blade may be used to peel paper product from the roll. Also, a doctor blade may be used in the application of the composite release layer by pressing the polymer composite into the spaces between the rigid portions and/or by removing excess polymer composite. As shown in FIG. 1, the roll 12 is rotating in a direction such that the doctor blade would scrape material from the surface of the roll, including juts.

Figure 2:
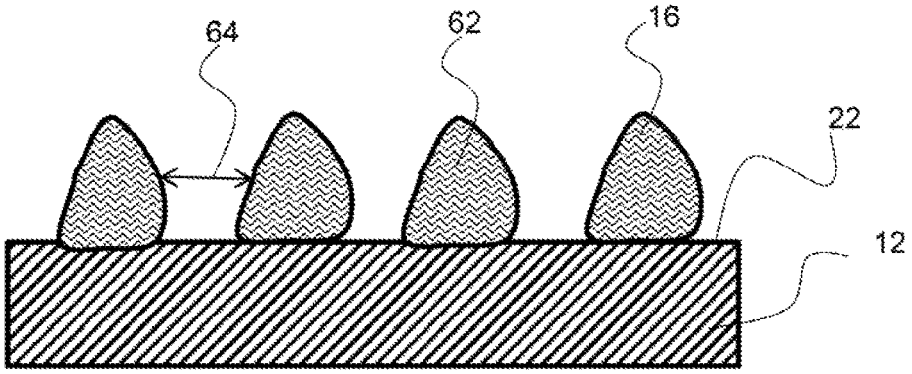
FIG. 2 shows a side sectional view of a portion of an exemplary processing roll with a porous rigid layer attached thereto.

As shown in FIG. 2, an exemplary processing roll 12 has an exemplary porous rigid layer 16 attached thereto. The rigid portions 62 are substantially tear drop shaped having an enlarged end attached to the contact surface 22 and smaller rounded portion that extends away from the contact surface. The rigid portions 62 are discrete rigid portions and are not connected to each other. There is a space 64 between the discrete rigid portions.

Figure 3:
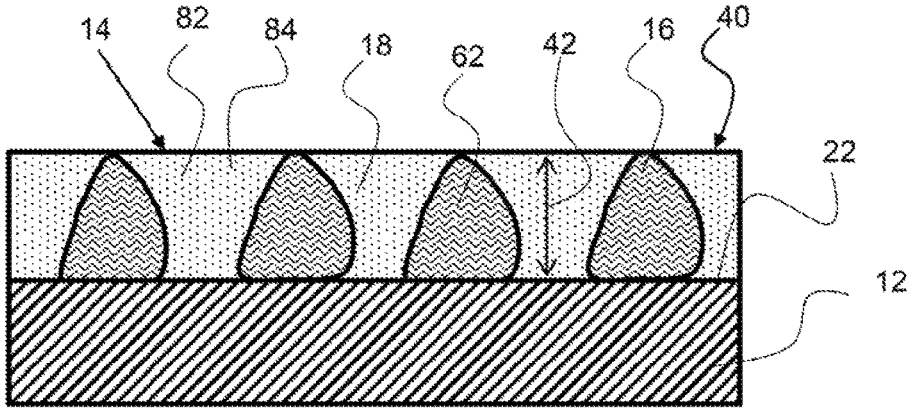
FIG. 3 shows a side sectional view of a portion of an exemplary processing roll with an exemplary release layer thereon.
Figure 4:
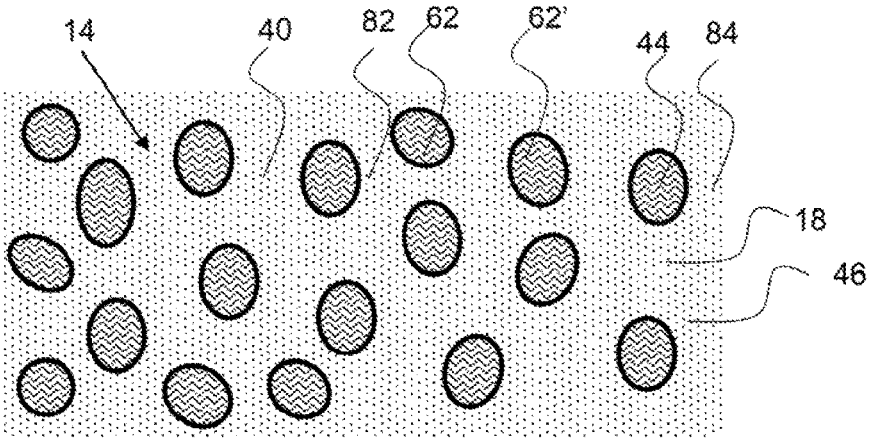
FIG. 4 shows a top-down view representation of the outside surface of the exemplary release layer shown in FIG. 3.

As shown in FIG. 3, an exemplary processing roll 12 has an exemplary release layer 14 thereon having a thickness 42. The release layer 14 comprises the porous rigid layer 16 and a polymer composite 18 configured between the spaces of the rigid portions 62. The polymer composite 18 comprises polymer 82 and particulate filler 84. As shown in FIG. 4 the outside surface 40 comprises a first exposed area 44 that is the rigid portions 62 and a second exposed area 46 that is the polymer composite 18.

Figure 5:
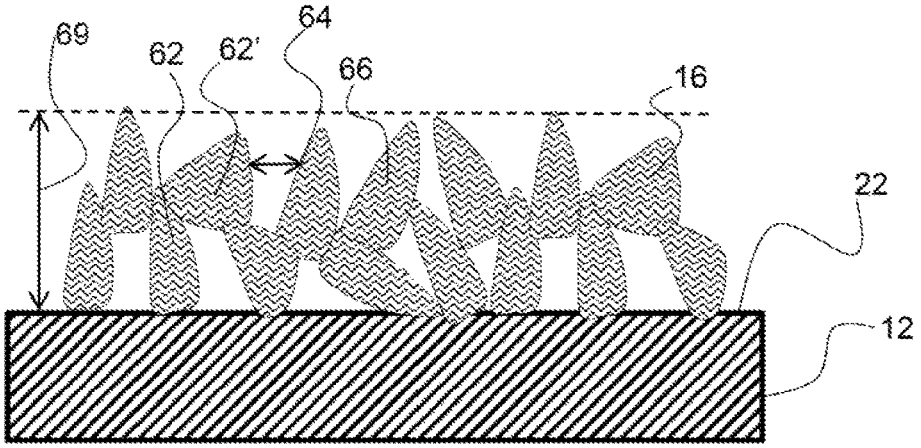
FIG. 5 shows a side sectional view of a portion of an exemplary processing roll with a porous rigid layer attached thereto.

As shown in FIG. 5, an exemplary processing roll 12 has a porous rigid layer 16 attached thereto having a thickness 69. The rigid portions 62 are irregular shaped. The discrete metal portions are attached to each other to form a contiguous network 66. Some of the rigid portions are attached to the contact surface 62, while others are only attached to other rigid portions 62', thereby building up the thickness 69 with a plurality of rigid portions stacked upon each other. The metal portions may be flame sprayed metal particles that harden when they impinge on the contact surface and attach to each to form the contiguous network. The thickness is the average thickness, as indicated by the dashed line, and may be determined by surface analysis including utilizing a surface profilometer. The porous rigid layer is a continuous network 66 of rigid portions 62. The rigid portions are coupled to each other to form a contiguous network.

Figure 6:
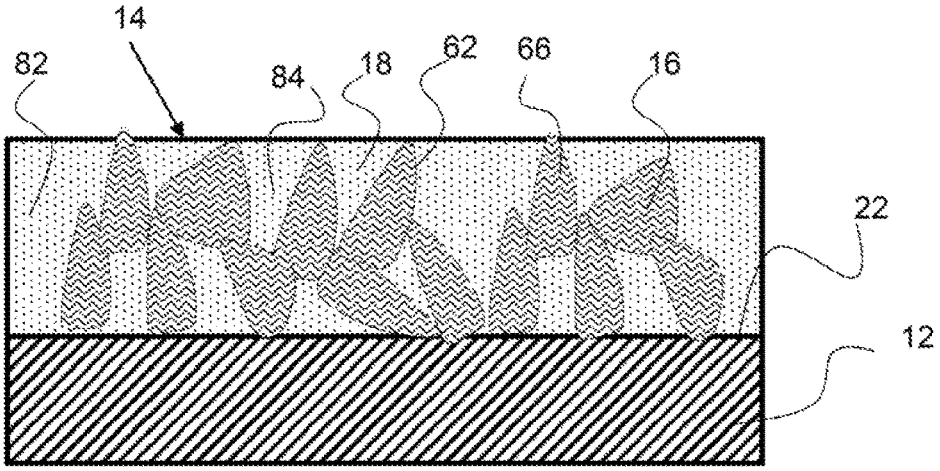
FIG. 6 shows a side sectional view of a portion of an exemplary processing roll with an exemplary release layer thereon.
Figure 7:
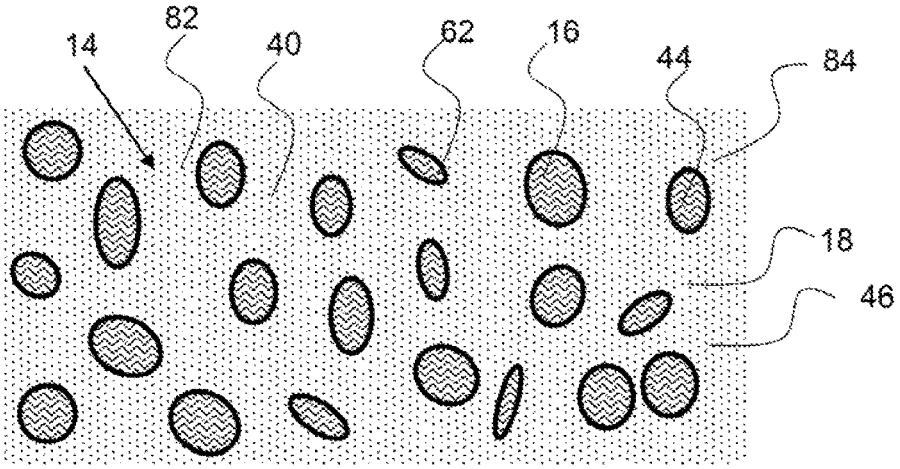
FIG. 7 shows a top-down view representation of the outside surface of the exemplary release layer shown in FIG. 6.

As shown in FIG. 6 an exemplary processing roll 12 has an exemplary release layer 14 thereon. The release layer 14 comprises the continuous porous rigid layer 16 and a polymer composite 18 configured between the spaces of the rigid portions 62. The polymer composite 18 comprises polymer 82 and particulate filler 84. As shown in FIG. 7 the outside surface 40 comprises a first exposed area 44 that is the rigid portions 62 and a second exposed area 46 that is the polymer composite 18. Note that the shape of the exposed area of the rigid portions is variable. Also note that the exposed rigid portions are discrete, in that they are not connected along the surface and are surrounded by polymer composite.

Figure 8:
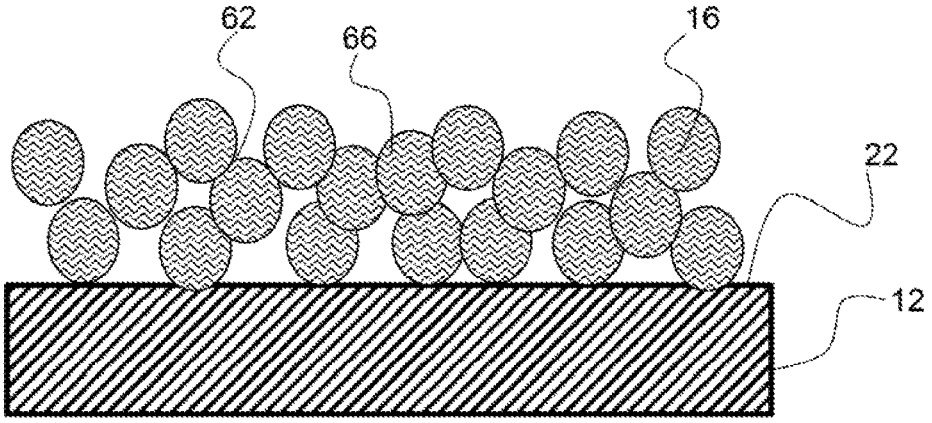
FIG. 8 shows a side sectional view of a portion of an exemplary processing roll with a porous rigid layer attached thereto.

As shown in FIG. 8 an exemplary processing roll 12 has a porous rigid layer 16 attached thereto. The porous rigid layer is a continuous network 66 of rigid portions 62. The rigid portions are substantially spherical and are coupled to each other to form a contiguous network. The rigid portions may be oblong, spherical, or irregularly shaped.

Figure 9:
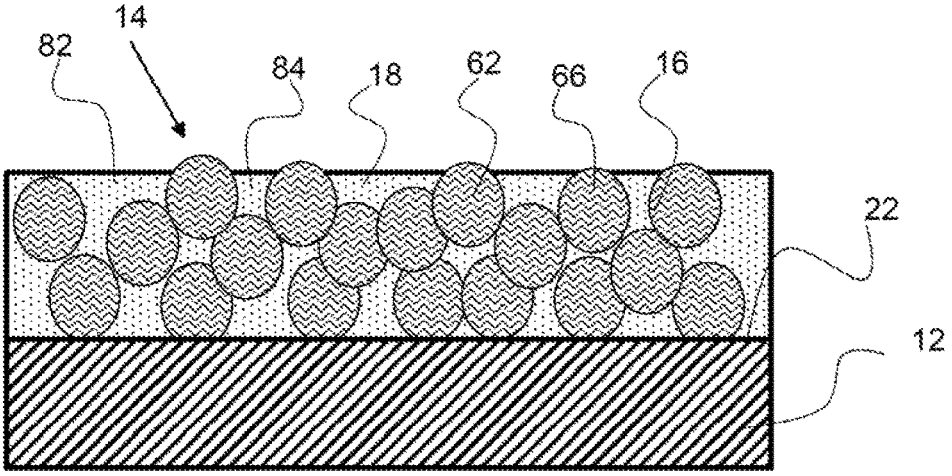
FIG. 9 shows a side sectional view of a portion of an exemplary processing roll with an exemplary release layer thereon.
Figure 10:
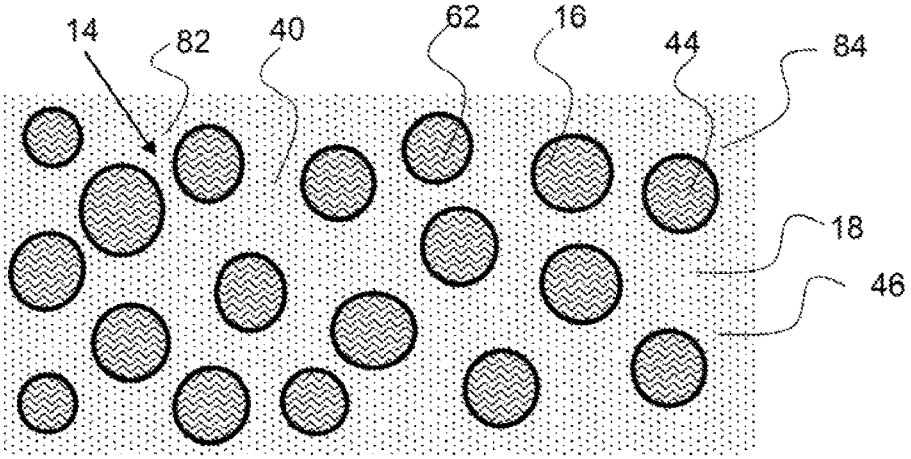
FIG. 10 shows a top-down view representation of the outside surface of the exemplary release layer shown in FIG. 9.

As shown in FIG. 9, an exemplary processing roll 12 has an exemplary release layer 14 thereon. The release layer 14 comprises the continuous porous rigid layer 16 and a polymer composite 18 configured between the spaces of the rigid portions 62. The polymer composite substantially fills the spaces of the porous rigid network, as shown. The polymer composite 18 comprises polymer 82 and particulate filler 84. As shown in FIG. 10, the outside surface 40 comprises a first exposed area 44 that is the rigid portions 62 and a second exposed area 46 that is the polymer composite 18.

Figure 11:
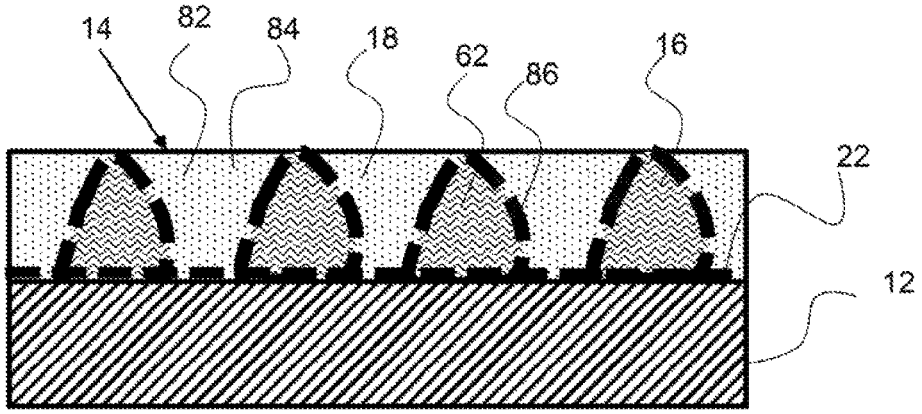
FIG. 11 shows a side sectional view of a portion of an exemplary processing roll with a releaser layer comprising a primer layer.

As shown in FIG. 11, an exemplary processing roll 12 has a release layer 14 having a primer layer 86. The primer layer may be a polymer that is applied to the porous rigid layer 16 prior to filling the spaces between the rigid portions with polymer composite 18. The primer layer may be thin, or low viscosity, and coat the contact surface 22 of the processing roll 12 and also coat the rigid portions 62.

It is to be understood that FIGS. 2 through 11 may equally demonstrate the composite release layer applied to any suitable contact surface, such as a plate or an implement, such as a doctor blade.

Figure 12:
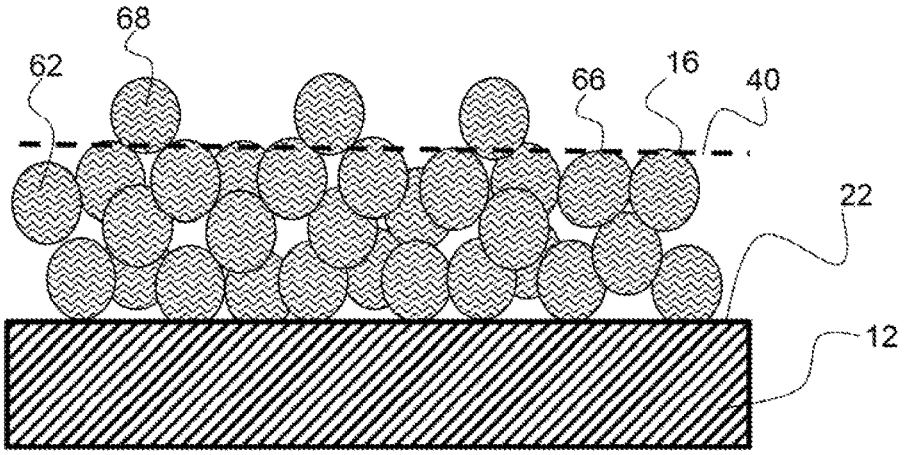
FIG. 12 shows a side sectional view of a portion of an exemplary processing roll with a porous rigid layer attached to the contact surface of the processing roll and a plurality of juts extending from the outside surface of the porous rigid layer.
Figure 13:
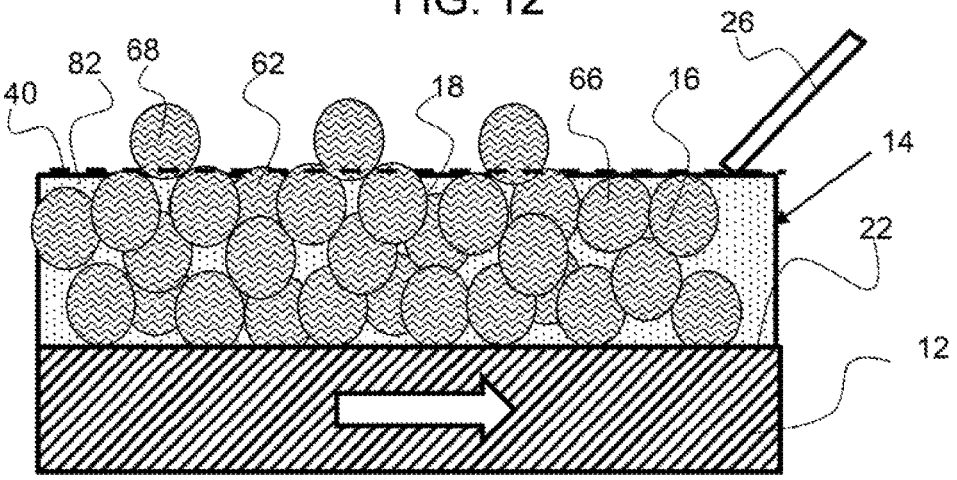
FIG. 13 shows a side sectional view of a portion of the exemplary processing roll shown in FIG. 12 with a polymer composite imbibed into the porous rigid layer and a plurality of juts extending from the outside surface of the release layer.
Figure 14:
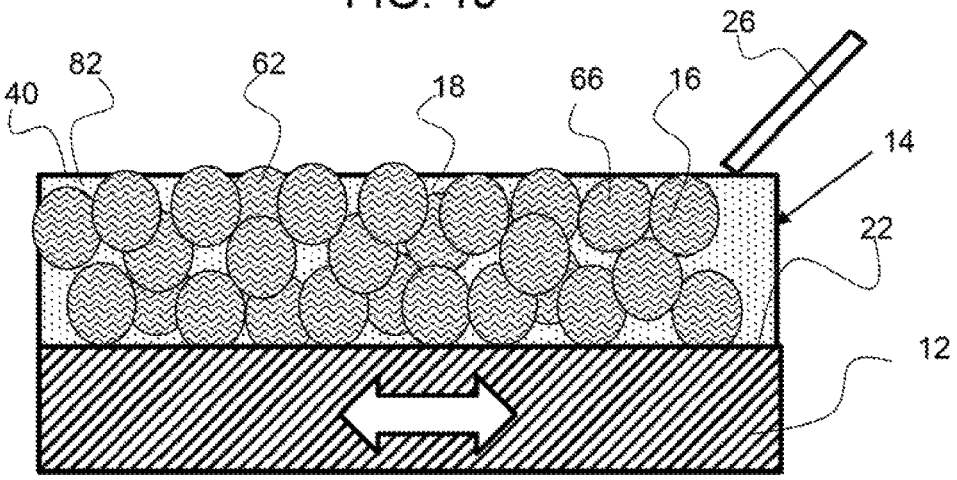
FIG. 14 shows a side sectional view of a portion of the exemplary processing roll shown in FIG. 13 with a juts removed by the scraping of the doctor blade across the outside surface of the release layer.

As shown in FIG. 12, an exemplary processing roll 12 has a porous rigid layer 16 attached to the contact surface 22 of the processing roll and a plurality of juts 68 extending from the outside surface 40 of the porous rigid layer. When depositing a porous rigid layer onto a contact surface, such as a roll 12, the metal particles may form a substantially consistent thickness with some rigid portions 62 that extend out from this average thickness to form juts 68. These juts may be removed by scrapping with a doctor blade or any other suitable scrapping implement, sanding, polishing and the like. The juts may be removed prior to or after the application of the polymer composite. As shown in FIG. 13, a doctor blade is pressed against the outside surface and the doctor blade is moved relative to the release layer to scrape away the juts. As shown in FIG. 14, the juts have been removed leaving a relatively uniform outside surface of the release layer comprising polymer composite and rigid portions 62.

Figure 15:
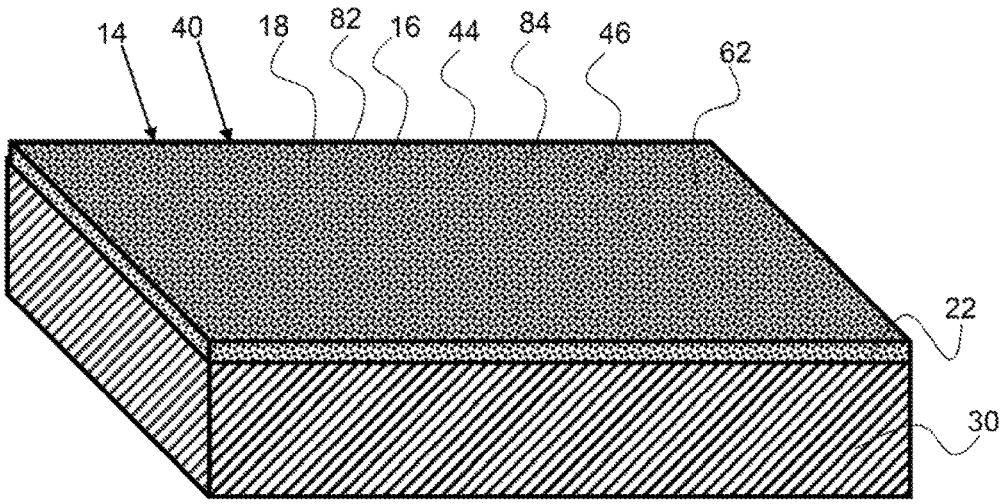
FIG. 15 shows a perspective view of a planar surface having a release layer attached thereto.

As shown in FIG. 15, a plate 30 has a composite release layer 14 attached thereto. A release layer may be applied to any suitable surface including plates, doctor blades or other implements that might be exposed to tacky materials. A release layer, as described herein, may be applied to any suitable contact surface 22, such as planar, as shown in this embodiment, curved in the case of rolls and any other shape.

Figure 16:
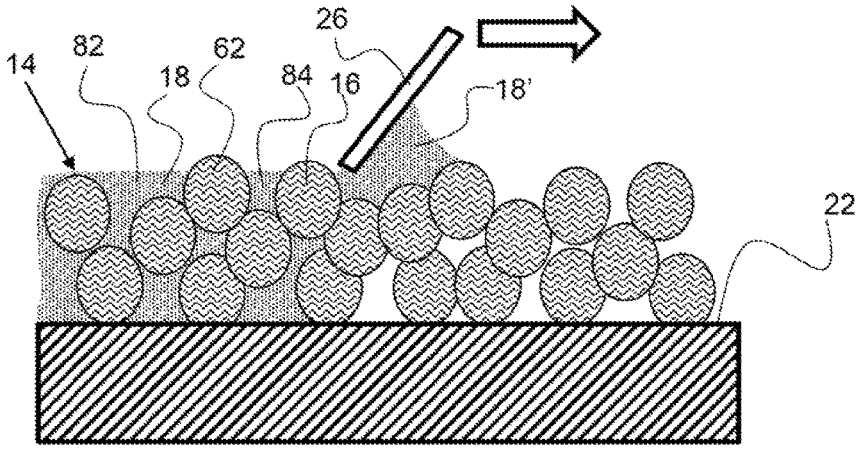
FIG. 16 shows a side sectional view of a portion of the exemplary contact surface with the polymer composite being pressed and forced into the spaces of the porous rigid layer by a doctor blade.

As shown in FIG. 16, an exemplary contact surface 22 has a porous rigid layer 16 applied thereto and a polymer composite 18' is being pressing into the spaces and voids of the porous rigid layer to form a composite release layer 14. A contact surface may be a plate that is planar or has a radius or any suitable curvature and a scrapping implement, such as a doctor blade may be used to press the polymer composite into the spaces between rigid portions. The scrapping implement may be moved or the contact surface may be moved as required.

DEFINITIONS

A rigid portion may be metal or a metal alloy, a ceramic or any other suitable rigid material having a Rockwell hardness of greater than about 50.

EXAMPLES

The primer may be Dow Corning 1200 RTV PRIME COAT having the contents as described in MSDS No. 01004018 incorporated by reference herein, following contents: The contents are provided in Table 1.

TABLE 1

1200 RTV MSDS No. 1004018

| CAS Number | Wt % | Component Name |
|---|---|---|
| 64742-89-8 | >60.0 | Light aliphatic petroleum solvent naphtha |
| 1330-20-7 | 5.0-10.0 | Xylene |
| 682-01-9 | 5.0-10.0 | Tetrapropyl orthosilicate |
| 5593-70-4 | 3.0-7.0 | Tetrabutyl titanate |
| 109-86-4 | 3.0-7.0 | Ethylene glycol methyl ether |
| 2157-45-1 | 1.0-5.0 | Tetra (2-methoxyethoxy) silane |
| 100-41-4 | 1.0-5.0 | Ethylbenzene |

The polymer used in the polymer composite may be Dow Corning 1890 Protective Coating having the contents as described in MSDS No. 01908278, incorporated by reference herein. The contents are provided in Table 2.

TABLE 2

| 1890 MSDS No. 01908278 | | |
|---|---|---|
| CAS Number | Wt % | Component Name |
| 64742-89-8 | 30.0-60.0 | Light aliphatic petroleum solvent naphtha |
| 7631-86-9 | 7.0-13.0 | Silica, amorphous |
| 1330-20-7 | 1.0-5.0 | Xylene |
| 4253-34-3 | 1.0-5.0 | Methyltriacetoxysilane |
| 17689-77-9 | 1.0-5.0 | Ethyltriacetoxysilane |
| 100-41-4 | 0.5-1.5 | Ethylbenzene |

The glass microspheres may comprise sodium borosilicate-based glass at approximately 75% and iron micropowder at approximately 25%. The microspheres may have a density of about 2.2 g/cc and a mean particle size of 30 microns.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of making a contact surface having a composite release layer comprising the steps of:

a) providing a contact surface on a processing roll;

b) providing a rigid material;

c) providing a polymer composite comprising:

i) a silicone polymer solution comprising a silicone polymer and a solvent; and ii) a particulate filler dispersed within the polymer and comprising microspheres having a particle size of less than 50 μm;

d) depositing the rigid material onto the contact surface of the processing roll to produce a porous rigid layer having a thickness and comprising a plurality of rigid portions having a space there between;

e) depositing the polymer composite into the porous rigid layer as a liquid solution; and f) scrapping an outside surface of the processing roll to remove excess polymer composite from the contact surface to produce a release layer comprising said polymer composite configured in the space between the plurality of rigid portions and an outside surface comprising:

i) a first exposed area consisting essentially of an exposed portion of the plurality of rigid portions; and ii) a second exposed area comprising the polymer composite;

wherein the release layer is configured on the contact surface of the processing roll.

2. The method of making a contact surface having a composite release layer of claim 1, wherein the step of depositing the rigid material on the contact surface comprises the step of flame spraying the rigid material onto the contact surface.

3. The method of making a contact surface having a composite release layer of claim 1, wherein the polymer composite further comprises a solvent comprising a hydrocarbon and wherein the silicone polymer is cured after the step of depositing the polymer composite into the porous rigid layer as a liquid solution.

4. The method of making a contact surface having a composite release layer of claim 3, wherein the solvent is a naphtha.

5. The method of making a contact surface having a composite release layer of claim 1, further comprising the step of removing a jut from the porous rigid layer.

6. The method of making a contact surface having a composite release layer of claim 1, wherein the step of depositing the polymer composite into the porous rigid layer comprises pressing the polymer composite into the porous rigid layer.

7. The method of making a contact surface having a composite release layer of claim 6, wherein the contact surface is a portion of the processing roll, and wherein the step of depositing the polymer composite into the porous rigid layer comprises pressing the polymer composite into the porous rigid layer with a doctor blade configured against the processing roll.

* * * * *